United States Patent [19]

Moreau et al.

[11] 4,350,113

[45] Sep. 21, 1982

[54] MOTORIZED FLOATBOARD

[76] Inventors: Roland Moreau, 510 Monty St., Province of Quebec, Canada, H7A 2C3; Robert Potvin, 6790 Renoir St., Auteuil, Canada, H7H 1A5

[21] Appl. No.: 174,019

[22] Filed: Jul. 31, 1980

[51] Int. Cl.[3] ..... A63H 5/08

[52] U.S. Cl. ..... 114/270; 441/74

[58] Field of Search ..... 114/270; 9/310 E, 310 F, 9/310 R

[56] References Cited

U.S. PATENT DOCUMENTS 2,045,645 6/1936 Hansen ..... 114/270
2,470,137 5/1949 Brown ..... 9/310 E
2,593,806 4/1952 Steele ..... 9/310 E
3,989,002 11/1976 Peterson ..... 114/270

*Primary Examiner*—Edward R. Kazenske
*Assistant Examiner*—Jesús D. Sotelo

[57] ABSTRACT

A motorized floatboard is disclosed, comprising: a hull having a plurality of watertight compartments, a power unit located aft, a steering device, also located aft, and adapted to be operated by the feet of a prone rider, an inclined chest plate, rearwardly-inclined leg plates. A throttle lever with an automatic cut-off switch is mounted on the deck. In case the rider wants to operate the floatboard in a standing position, an elongated pivotable handle is provided and the craft is then steered by shifting body weight.

7 Claims, 5 Drawing Figures

MOTORIZED FLOATBOARD

FIELD OF THE INVENTION

The present invention relates to a powered recreational aquatic craft, more specifically to a motorized floatboard having distinct advantages over the prior art.

BACKGROUND OF THE INVENTION

Nautical sportsmen are constantly looking for thrills and challenge on the water. To satisfy their needs, the prior art has provided diverse crafts. For example, U.S. Pat. No. 3,371,646 discloses a motorized floatboard. However, in this Patent, the power unit is located forwardly of the rider, thus presenting a danger if part of the power unit were to become detached. Another disadvantage of this Patent is that the user's legs are meant to be partially in the water.

Canadian Pat. No. 831,291 also teaches the use of a floatboard. The drawback of this Patent is that the rider can only stand on the board.

Yet another Patent (U.S. Pat. No. 2,931,332) teaches the use of hydrofoils on a thin board. This device could not be used safely in an area where there are other pleasure crafts and/or swimmers.

OBJECTS OF THE INVENTION

It is a prime object of the present invention to provide a motorized floatboard which is non-costly and fail-safe, should the rider happen to fall off the craft.

It is another object of the present invention to provide a motorized floatboard which can attain relatively high speeds over open water.

It is yet another object of the present invention to provide a motorized floatboard which is easily portable out of the water.

It is still another object of the present invention to provide a motorized floatboard which may be ridden either in a standing or prone position.

It is still another object of the present invention to provide a motorized floatboard which is sinkproof.

SUMMARY OF THE INVENTION

The above and other objects of the present invention are realized in accordance with a preferred embodiment comprising a highly buoyant-like hull which is generally flat and preferably tapers to a point at the front end. The hull is provided with at least two watertight compartments and at least one bulkhead. Each watertight compartment may be filled with air or suitable buoyant material.

The hull has an upper surface, or deck, and a rearwardly, centrally located power unit, namely an internal combustion engine with a starter motor. This engine operates a propeller mounted at the end of a relatively short leg which projects downwardly into the water. The power unit is enclosed in a protecting cowl. Rearwardly of the leg and also centrally located is a rudder which is connected to a steering means adapted to be operated by the feet of the rider, if the latter is riding in a prone position. In the case where the rider is standing, the craft may be steered by simple body movement.

Located slightly ahead of the mid-length portion of the hull is preferably an upwardly- and forwardly-inclined chest plate to raise the upper body of a prone rider. Preferably, similar leg plates are provided at the rear portion of the deck on either side of the cowl to raise the lower legs of a prone rider, so that they can operate the steering means. These leg plates are rearwardly inclined.

The deck is further provided with a throttle lever forwardly of the chest plate and two transversely spaced-apart handle grips, also located forwardly of the chest plate. An ignition switch and a starter switch are also provided on the deck near the throttle lever and are part of the conventional electric circuit of the engine. An electrical power source is located in the board and connected in said circuit.

Preferably the throttle lever has an automatic cut-off switch to shut off the power unit instantly should the rider fall overboard.

A fuel reservoir for the engine is located in the board.

Should a rider wish to operate the floatboard in a standing position, two laterally spaced-apart foot cushions are preferably provided, one on each side of the chest plate. A longitudinally pivotable elongated handle is preferably fixed to the deck forwardly of the chest plate and is equipped with a throttle lever to operate the floatboard while in a standing position.

The above will be more clearly understood by having reference to the preferred embodiment of the invention illustrated, by way of the accompanying drawings, in which:

BRIEF DESCRIPTION OF THE DRAWINGS

Like numerals refer to like elements throughout the drawings.

DETAILED DESCRIPTION OF THE INVENTION

Figure 1:
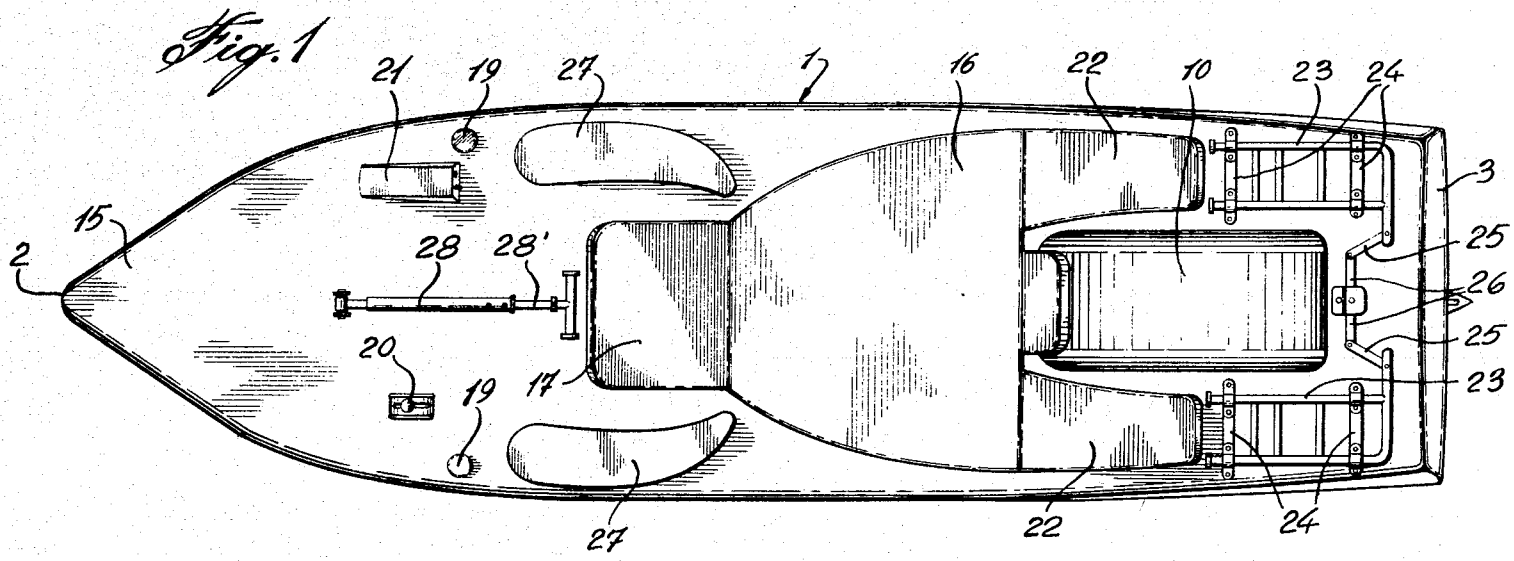
FIG. 1 is a top plan view of the floatboard.

The floatboard comprises a hollow hull 1 tapering to a bow point 2 and a transversely straight stern 3. The bottom surface 4 of hull 1 is flat along most of its length, curving slightly upwardly at its front portion to meet bow point 2.

A very short keel 5 is provided centrally and longitudinally on bottom surface 4.

The side walls 6 of hull 1 are downwardly inwardly inclined along most of the length of the latter but become downwardly outwardly inclined at the stern portion of the floatboard.

Hull 1 is formed of suitable rigid and buoyant material and is provided with a plurality of watertight compartments 7 separated by bulkheads 8, thus making the craft unsinkable.

A power unit 9 (preferably a modified outboard motor with an electric starter) is located centrally and near the stern portion of the floatboard under a protective cowl 10. Power unit 9 has a shortened leg 11 carrying a propeller driven by the power unit 9. Leg 11 extends downwardly into the water. A battery 12, also located under the cowl is connected in the conventional electric circuit of the outboard motor to energize the electric starter and other electric elements of the motor.

Immediately aft of power unit 9, hull 1 is provided with a rudder 13. This rudder 13 is mechanically linked to a steering means to be described below.

The forward portion of hull 1 includes a fuel reservoir 14 connected to power unit 9.

The deck 15 of hull 1 is provided with a flat wide cushion 16 adapted to support the torso of a prone rider (not shown). Forwardly of cushion 16 is an adjustably-positioned chest plate 17, also made of cushion material. The adjusting means consists of a short telescopic arm 18. Thus, the chest and head of a prone rider assume a comfortable inclined position, whereby the rider may see clearly what is ahead without strain.

A pair of transversely spaced-apart handle grips 19 are provided on deck 15 at the front portion of hull 1 for the rider to grasp with both hands.

A throttle lever 20 is also provided on deck 15 to control the speed of the outboard motor. Throttle lever 20 has an automatic cut-off switch (not shown) which instantly shuts off power unit 9, should the rider happen to fall off the floatboard.

An ignition switch and a starter switch shown at 21 are also provided on deck 15 near handle grips 19.

Immediately aft of cushion 16 are a pair of leg plates 22, also having a cushion surface, and adapted to support the lower legs of the rider. Leg plates 22 are located on either side of cowl 10 and are upwardly rearwardly inclined. They are also adjustable by means of telescopic arms 18. The purpose of leg plates 22 is to advantageously position the feet of a rider in the steering means.

The latter consists of a pair of longitudinally slidable and horizontal ladder members 23 slidably held by brackets 24 on either side of power unit 9. The rear end of each ladder member 23 is pivotally connected to a short pivot rod 25 which in turn is connected to a second rod 26, which is rigidly secured to the rudder 13. It will be obvious that a simple push or pull action on ladder members 23, by the rider's feet, will cause rudder 13 to turn in the desired direction.

Means are preferably provided to ride the floatboard in a standing position, if a rider so desires. The means consists of, firstly, a pair of foot cushions 27 straddling chest plate 17 and, secondly, a longitudinally pivotable and elongated handle 28. The latter is provided with a finger-operated throttle (not shown) to control the speed of the craft. To steer the floatboard, the standing rider need only shift his weight to the side of the desired direction.

Figure 2:
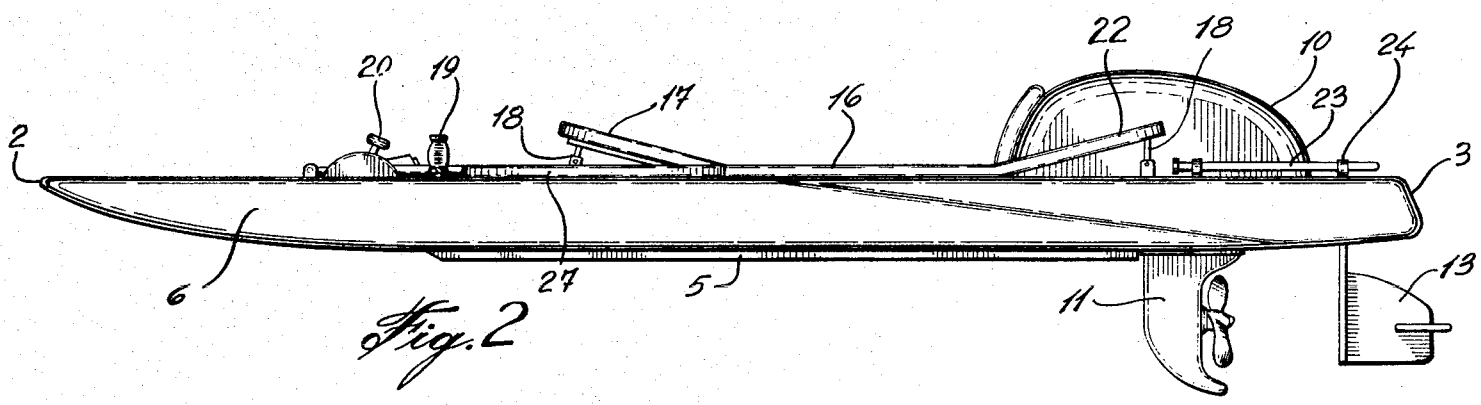
FIG. 2 is a side elevation of the same.
Figure 3:
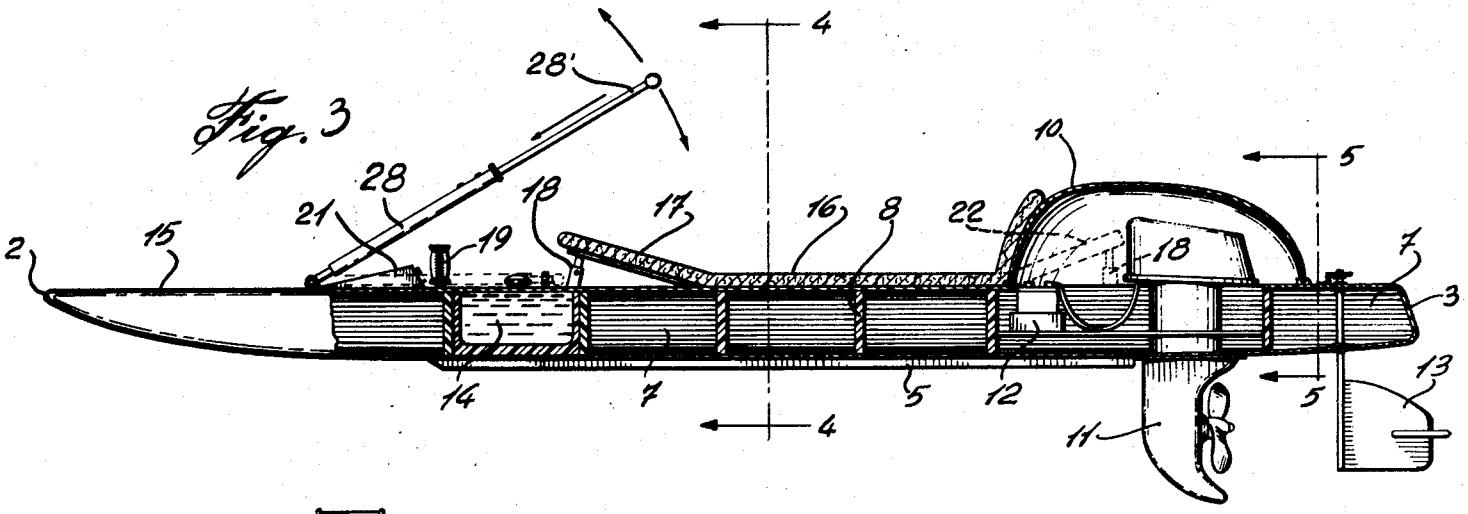
FIG. 3 is another side elevation with most of the floatboard longitudinally sectioned to show the interior elements and construction.
Figure 4:
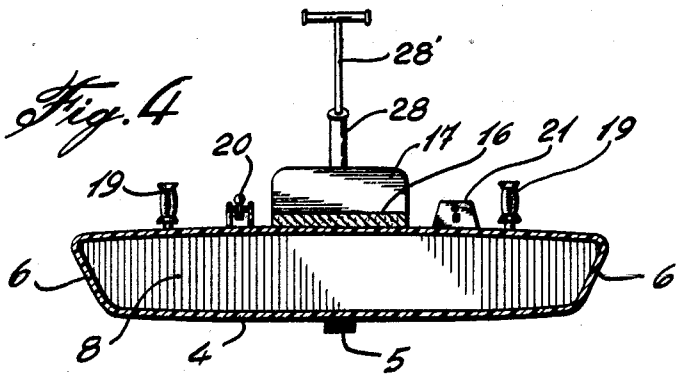
FIG. 4 is a cross-sectional view taken along line 4—4 of FIG. 3.
Figure 5:
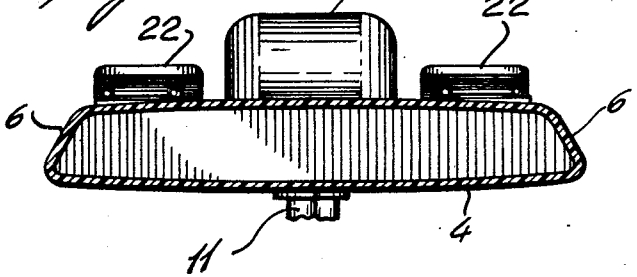
FIG. 5 is another cross-sectional view taken along line 5—5 of FIG. 3.

Handle 28 is adjustable in length, having a telescoped member 28' and can be stored flat against deck 15, when not in use, as shown in FIGS. 1 and 2.

It is to be noted that the watertight compartments 7 may be filled either with air or with an expanded plastic foam.

A prototype of the floatboard has been tested and has obtained speeds of up to 45 mph.

What we claim is:

1. A motorized floatboard comprising a generally flat and at least partially hollow hull tapering at its front end, said hull having a deck long enough to support a rider in prone condition, at least two watertight compartments separated by a bulkhead, a fuel-operated and self-starting power unit located centrally and at the rear portion of said hull and having a propelling leg extending downwardly into the water, a rudder located aft of said power unit, a steering means located at the rear portion of said hull astride of said power unit to operate said rudder by the feet of a prone rider, an electrical power source for said power unit and located in said hull, a fuel reservoir also located in said hull, and spaced-apart handle grips and control means for said power unit mounted on said deck at the front portion of said hull and accessible to the hands of a prone rider, and wherein said power unit is protected by a cowl and said steering means consists of a pair of longitudinally-slidable ladder members, one on each side of said power unit, each said ladder member being linked to said rudder, whereby the floatboard may be steered by a prone rider by simple push or pull action on said ladder members by the feet of said rider.

2. A motorized floatboard as defined in claim 1, further including a pair of adjustably-positionable upwardly- and rearwardly-inclined leg plates, one on each side of said power unit.

3. A motorized floatboard as defined in claim 1, wherein said deck is further provided with an upwardly forwardly inclined chest plate which is adjustably positioned.

4. A motorized floatboard as defined in claim 3, wherein said deck is further provided with a longitudinally pivoted elongated handle having a finger-operated throttle whereby the floatboard may be ridden in a standing position, and a pair of foot cushions straddling said chest plate.

5. A motorized floatboard as defined in claim 1 or 4 further including a pair of upwardly rearwardly inclined leg plates, one on each side of said power unit, adapted to advantageously position the feet of a prone rider in said steering means.

6. A motorized floatboard as defined in claim 1, wherein said control means include an ignition switch, a starter switch and a throttle lever.

7. A motorized floatboard as defined in claim 1, wherein the bottom surface of said hull is provided with a short keel along most of its length.

* * * * *